US012662767B2

(12) United States Patent
Kang et al.

(10) Patent No.: US 12,662,767 B2
(45) Date of Patent: Jun. 23, 2026

(54) BASE, BASE ASSEMBLY AND LAUNDRY TREATMENT DEVICE

(71) Applicant: Wuxi Little Swan Electric Co., Ltd., Wuxi (CN)

(72) Inventors: Fei Kang, Wuxi (CN); Hao Jiang, Wuxi (CN); Yulai Miao, Wuxi (CN)

(73) Assignee: Wuxi Little Swan Electric Co., Ltd., Wuxi (CN)

( * ) Notice: Subject to any disclaimer, the term of this patent is extended or adjusted under 35 U.S.C. 154(b) by 232 days.

(21) Appl. No.: 18/576,231

(22) PCT Filed: Jun. 29, 2023

(86) PCT No.: PCT/CN2023/104011
§ 371 (c)(1),
(2) Date: Jan. 3, 2024

(87) PCT Pub. No.: WO2024/002265
PCT Pub. Date: Jan. 4, 2024

(65) Prior Publication Data

US 2025/0084582 A1 Mar. 13, 2025

(30) Foreign Application Priority Data

Jun. 30, 2022 (CN) ..... 202221695430.6
Oct. 17, 2022 (CN) ..... 202211268932.5

(51) Int. Cl.
*D06F 39/12* (2006.01)
*A47L 11/40* (2006.01)
*D06F 58/20* (2006.01)

(52) U.S. Cl.
CPC ..... *D06F 39/125* (2013.01); *A47L 11/4091* (2013.01); *D06F 39/12* (2013.01); *D06F 58/20* (2013.01)

(58) Field of Classification Search
CPC ..... A47L 11/282; A47L 11/20; A47L 11/24; A47L 11/40; A47L 11/4091;
(Continued)

(56) References Cited

U.S. PATENT DOCUMENTS 10,590,593 B1 * 3/2020 Leibman ..... A47L 7/009
2004/0263032 A1 * 12/2004 Cho ..... A47B 67/04 312/330.1

(Continued)

FOREIGN PATENT DOCUMENTS

CN 207646465 U 7/2018
CN 112294201 A 2/2021

(Continued)

OTHER PUBLICATIONS

Machine translation of CN 113062091 A to Cao et al. (Year: 2021).*

(Continued)

*Primary Examiner* — Joseph L. Perrin
(74) *Attorney, Agent, or Firm* — Anova Law Group, PLLC

(57) ABSTRACT

A base includes a bottom plate assembly including a subbase. A front edge of the subbase includes a flanging folded upward and including an avoidance section, and a climbing plate is arranged above the avoidance section. The base further includes a structural support assembly arranged above the bottom plate and forming an accommodation space above the subbase. An access opening is provided on a front side of the accommodation space.

20 Claims, 15 Drawing Sheets

(58) Field of Classification Search
CPC ... A47L 2201/02; D06F 39/12; D06F 39/125; D06F 58/20
See application file for complete search history.

(56) References Cited

U.S. PATENT DOCUMENTS

| | | | | |
|---|---|---|---|---|
| 2007/0159034 | A1* | 7/2007 | Funcken | D06F 39/12 312/257.1 |
| 2022/0066456 | A1* | 3/2022 | Ebrahimi Afrouzi | G06F 3/04883 |
| 2022/0136165 | A1* | 5/2022 | Xu | D06F 58/20 34/603 |
| 2024/0180389 | A1* | 6/2024 | Miao | A47L 11/4091 |
| 2024/0260807 | A1* | 8/2024 | Ohm | A47L 9/149 |

FOREIGN PATENT DOCUMENTS

| | | | | | |
|---|---|---|---|---|---|
| CN | 113062091 | A | | 7/2021 | |
| CN | 113440075 | A | * | 9/2021 | A47L 11/4011 |
| CN | 113545718 | A | | 10/2021 | |
| CN | 113598663 | A | | 11/2021 | |
| CN | 214782729 | U | | 11/2021 | |
| CN | 114521845 | A | | 5/2022 | |
| CN | 216776939 | U | * | 6/2022 | |
| CN | 218779188 | U | | 3/2023 | |
| CN | 218779189 | U | | 3/2023 | |
| EP | 2063012 | A1 | | 5/2009 | |
| RU | 2699837 | C1 | | 9/2019 | |
| WO | 2019225950 | A1 | | 11/2019 | |
| WO | 2021235847 | A1 | | 11/2021 | |

OTHER PUBLICATIONS

Machine translation of CN 113440075 A to Liu et al. (Year: 2021).*
Machine translation of CN 214782729 U to Li et al. (Year: 2021).*
Machine translation of CN 216776939 U to Chen et al. (Year: 2022).*
The World Intellectual Property Organization (WIPO) International Search Report and Written Opinion for PCT/CN2023/104011 Oct. 5, 2023 12 Pages (including translation).
Patent Office of the Russian Federation Search Report and Office Action for Application No. 2024100823/03(001530) Jun. 4, 2024 12 pages (including translation).
The European Patent Office (EPO) The Extended European Search Report for Application No. 23828319.6 Apr. 15, 2024 30 Pages.
The China National Intellectual Property Administration (CNIPA) The First Office Action for Chinese Application 202211268932.5 Sep. 18, 2025 18 Pages (With Translation).

* cited by examiner

BASE, BASE ASSEMBLY AND LAUNDRY TREATMENT DEVICE

CROSS-REFERENCE TO RELATED APPLICATIONS

This application is a National Stage Entry under 35 U.S.C. § 371 of International Application No. PCT/CN2023/104011, filed on Jun. 29, 2023, which claims priority to Chinese Patent application No. 202221695430.6 filed on Jun. 30, 2022 and Chinese Patent application No. 202211268932.5 filed on Oct. 17, 2022, the contents of which are hereby incorporated by reference in their entireties.

TECHNICAL FIELD

The present disclosure relates to the technical field of cleaning, and in particular to a base, a base assembly, and a laundry treatment device.

BACKGROUND

In the related art, a station is provided for a robot cleaner. A high pillar is arranged on a rear side of the station, and a dust removal system is arranged in the pillar. The dust discharge, charging, storage or other functions of the robot cleaner are achieved through the station. However, the station occupies a large indoor space due to a large volume thereof.

SUMMARY

In view of this, embodiments of the present disclosure are intended to provide a base, a base assembly, and a laundry treatment device which can be easily integrated with a laundry treatment machine.

An embodiment of the present disclosure provides a base, the base includes a bottom plate assembly and a structural support assembly arranged above the bottom plate assembly.

The bottom plate assembly includes a subbase, the structural support assembly forms an accommodation space located above the subbase and configured to accommodate a robot cleaner, an access opening is provided on a front side of the accommodation space.

A front edge of the subbase is provided with a flanging which is folded upward and includes an avoidance section along a width direction of the subbase, a climbing plate is arranged above the avoidance section.

In some embodiments, the avoidance section is configured to have a constant height in a length direction of the flanging.

In some embodiments, the avoidance section is concave and forms a recessed front edge.

In some embodiments, in the width direction of the subbase, the flanging includes a heightened section arranged on a right side of the avoidance section, and a height of the heightened section is higher than a height of the avoidance section.

In some embodiments, at least a part of region of the subbase is recessed downward and forms a sunken bearing region, and a front edge of the sunken bearing region is folded upward and forms the flanging.

In some embodiments, a height of the avoidance section is lower than a height of a non-recessed region of the subbase.

In some embodiments, a part of the sunken bearing region protrudes upward to form at least one reinforcement rib, a height of the reinforcement rib is lower than a height of a non-recessed region of the subbase.

In some embodiments, there are a plurality of reinforcement ribs arranged at intervals in a front-rear direction; each of the reinforcement ribs includes at least one first reinforcement rib and at least one second reinforcement rib, each of the first reinforcement ribs is arranged on a front side of each of the second reinforcement ribs, and a height of each of the first reinforcement ribs is higher than a height each of the second reinforcement ribs.

In some embodiments, a height of the avoidance section is higher than the height of each of the second reinforcement ribs and lower than the height of each of the first reinforcement ribs.

In some embodiments, the structural support assembly includes a plurality of support pillars and a plurality of cross beams, a bottom end of each of the support pillars is supported on a non-recessed region of the subbase, and each of the cross beams is connected to a top end of each of the support pillars.

In some embodiments, the bottom plate assembly includes a plurality of edgefold sets bent upward from an edge of the non-recessed region, each of the edgefold sets includes a first edgefold and a second edgefold, an outer side of each of the support pillars in a left-right direction is in close contact with and fixedly connected to at least a part of a region of the second edgefold, and an outer side of the support pillar in a front-rear direction is in close contact with and fixedly connected to at least a part of a region of the first edgefold.

In some embodiments, the bottom plate assembly includes a plurality of connection edgefolds bent upward from an edge of the non-recessed region respectively, two second edgefolds on a same side are connected to one another by one of the connection edgefolds, and two first edgefolds on a rear side are connected to one another by another one of the connection edgefolds.

In some embodiments, a height of the avoidance section is lower than a height of the connection edgefold.

In some embodiments, a part of the second edgefold is recessed toward a side of the accommodation space and forms a mounting avoidance region which is in close contact with the support pillars, and a fastener passes through the mounting avoidance region and the support pillars sequentially.

In some embodiments, two support pillars on a same side and the respective cross beam between the two support pillars are formed as a sheet metal frame formed by bending a same metal plate several times.

In some embodiments, the bottom plate assembly is a one-piece sheet metal part; and/or, the base includes a cover plate which is arranged on a top side of the structural support assembly and covers the accommodation space.

An embodiment of the present disclosure provides a base assembly, the base assembly includes a pedestal and the base according to the embodiments of the present disclosure.

The pedestal is provided with a receiving cavity for receiving a robot cleaner, a front end of a bottom wall of the pedestal is provided with a climbing plate.

The pedestal is arranged in the accommodation space, and the climbing plate is arranged above the avoidance section.

In some embodiments, the base assembly includes a dust box arranged on a right side of the receiving cavity, and the dust box is located on a right side of the climbing plate.

An embodiment of the present disclosure provides a laundry treatment device. The laundry treatment device includes a laundry treatment machine and the base assembly according to the embodiments of the present disclosure. The laundry treatment machine is supported on the structural support assembly.

According to the laundry treatment device of the embodiment of the present disclosure, the base assembly is integrated below the laundry treatment machine. On one hand, the space below the laundry treatment machine may be used to accommodate the robot cleaner, so that the indoor space occupied by the robot cleaner is reduced. On the other hand, the laundry treatment machine is arranged near a water tap and a floor drain to facilitate water intake and discharge, which facilitates water intake and discharge of the base assembly through the existing water intake and discharge of the laundry treatment machine. The water intake and discharge pipelines of the base assembly can be simplified. The presence of the avoidance section facilitates the arrangement of the climbing plate to avoid the avoidance section, and facilitates the mounting and the removal of the climbing plate. The flanging may enhance the structural strength of the subbase member.

DETAILED DESCRIPTION

Figure 1:
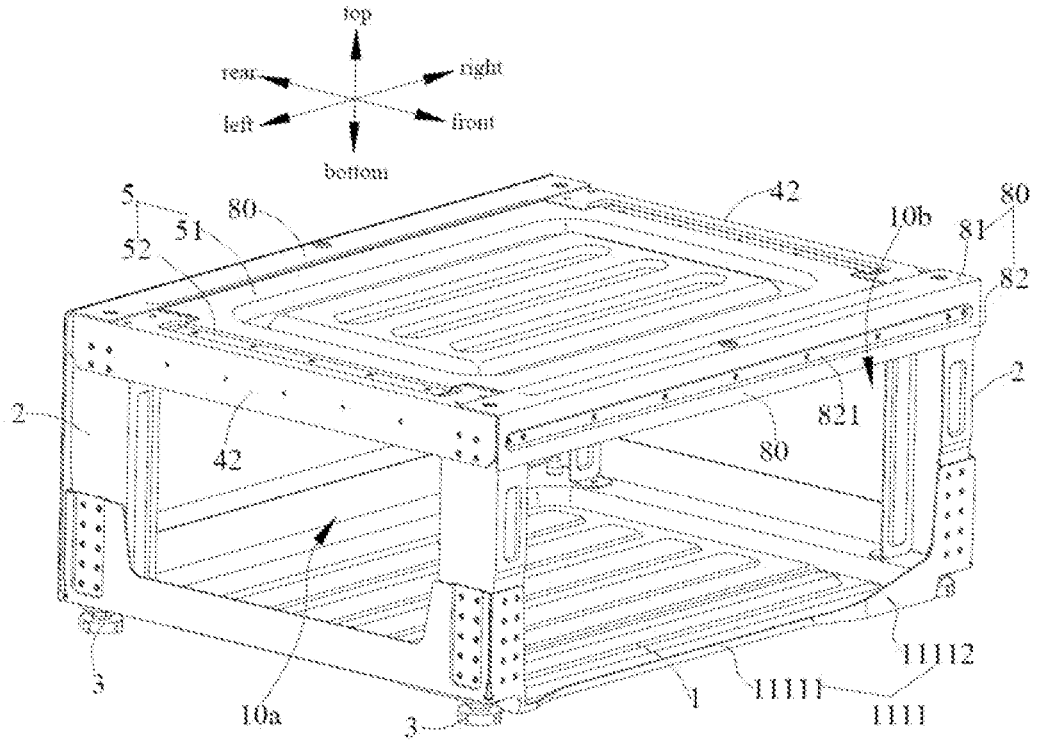
FIG. 1 is a schematic view of cooperation between a base and a connection plate according to an embodiment of the present disclosure.

Embodiments of the present disclosure are further described in detail below with reference to the drawings and embodiments. The following embodiments are intended to explain the present disclosure, but cannot be used to limit the scope of the present disclosure.

In descriptions of the embodiments of the present disclosure, it should be noted that orientation or positional relationships indicated by terms "center," "longitudinal," "transverse," "upper," "lower," "front," "rear," "left," "right," "vertical," "horizontal," "top," "bottom," "inner," "outer," or the like are based on orientation or positional relationships shown in the drawings, are only intended to facilitate describing the embodiments of the present disclosure and simplify the descriptions, and are not intended to indicate or imply that the referred device or element must have a specific orientation or must be configured and operate in a specific orientation, therefore cannot be understood as limitation to the embodiments of the present disclosure. Furthermore, terms "first," "second" and "third" are only for the purpose of description, and cannot be understood to indicate or imply relative importance.

An embodiment of the present disclosure provides a base 10. The base 10 may be used in a laundry treatment device.

Figure 2:
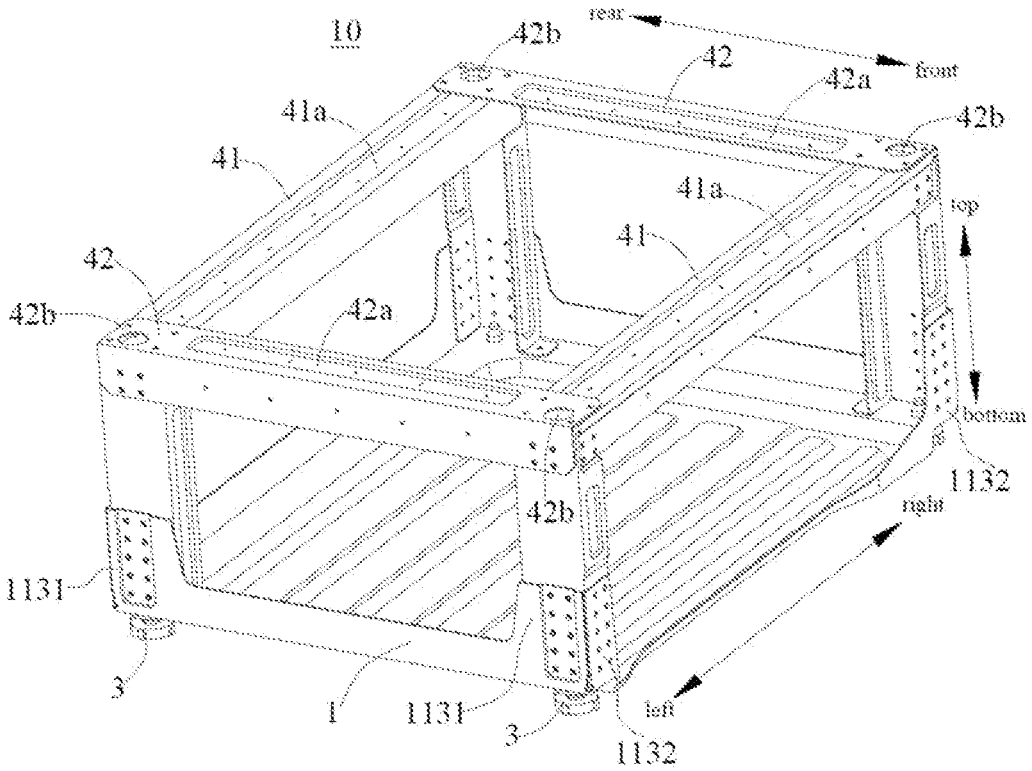
FIG. 2 is a schematic structural view of a part of the base shown in FIG. 1, in which a cover plate is omitted.
Figure 3:
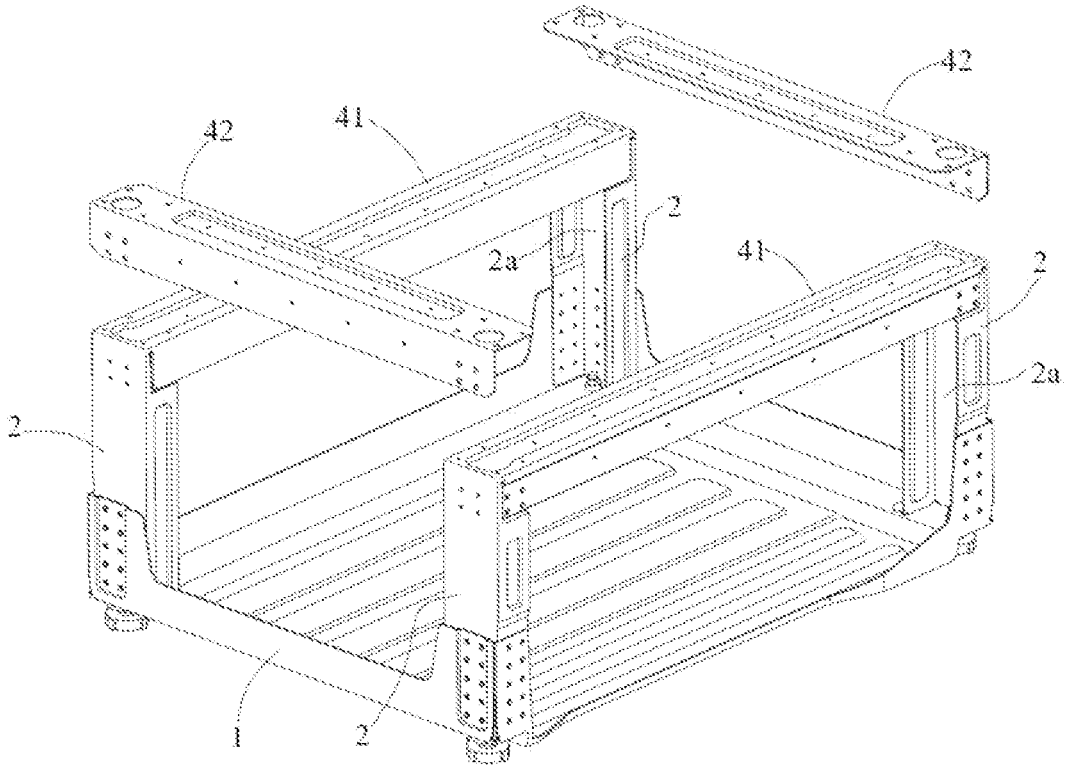
FIG. 3 is a schematic exploded view of a part of the structure shown in FIG. 2.

With reference to FIG. 1, FIG. 2 and FIG. 3, the base 10 includes a bottom plate assembly 1 and a structural support assembly arranged above the bottom plate assembly 1. The bottom plate assembly 1 includes a subbase 11, the structural support assembly forms an accommodation space 10*a* located above the subbase and configured for accommodating a robot cleaner 90. An access opening 10*b* is provided on a front side of the accommodation space 10*a*, that is, the robot cleaner 90 enters and exits the space within the base 10 from the access opening 10*b*.

It should be noted that the subbase 11 may be in the form of a plate, or may be in the form of a combination of a plate and a support beam. In one example, in the embodiment of the present disclosure, descriptions are made by taking the subbase 11 in the form of the plate as an example.

Figure 12:
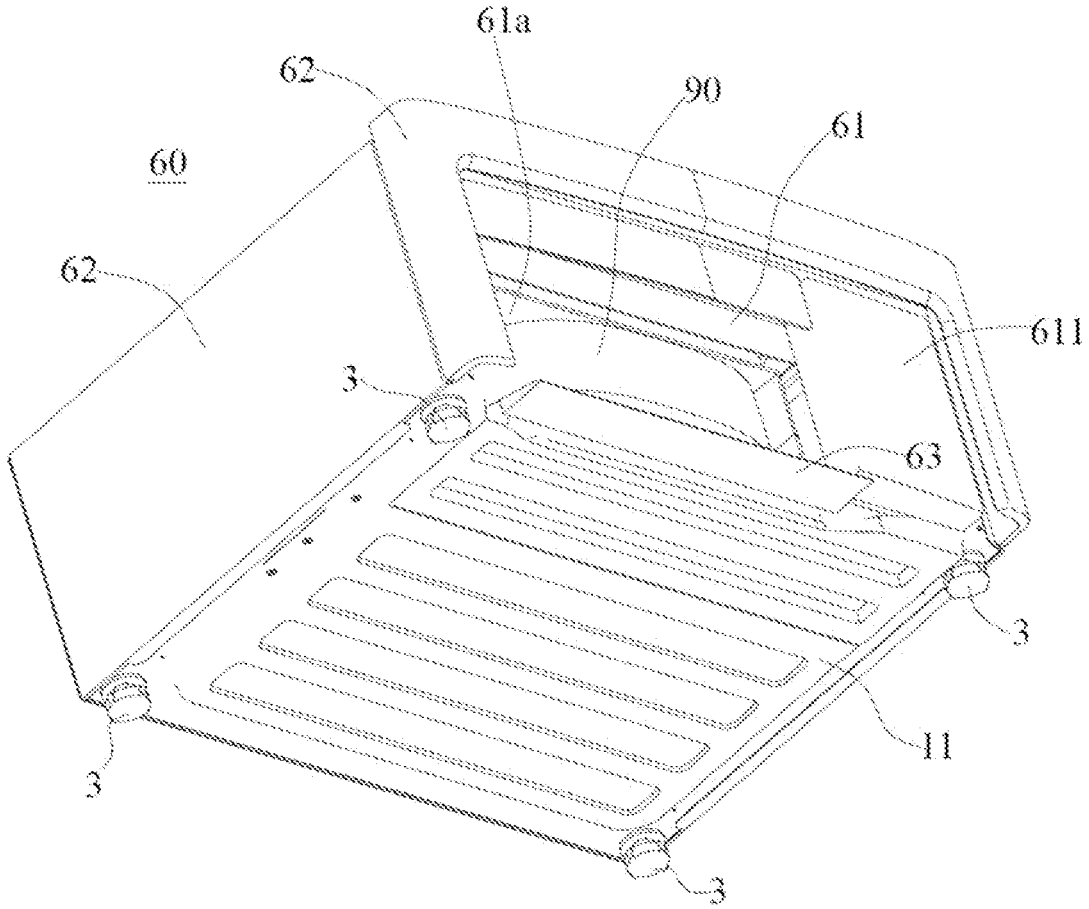
FIG. 12 is a schematic view of cooperation between a base assembly and a robot cleaner according to an embodiment of the present disclosure.
Figure 13:
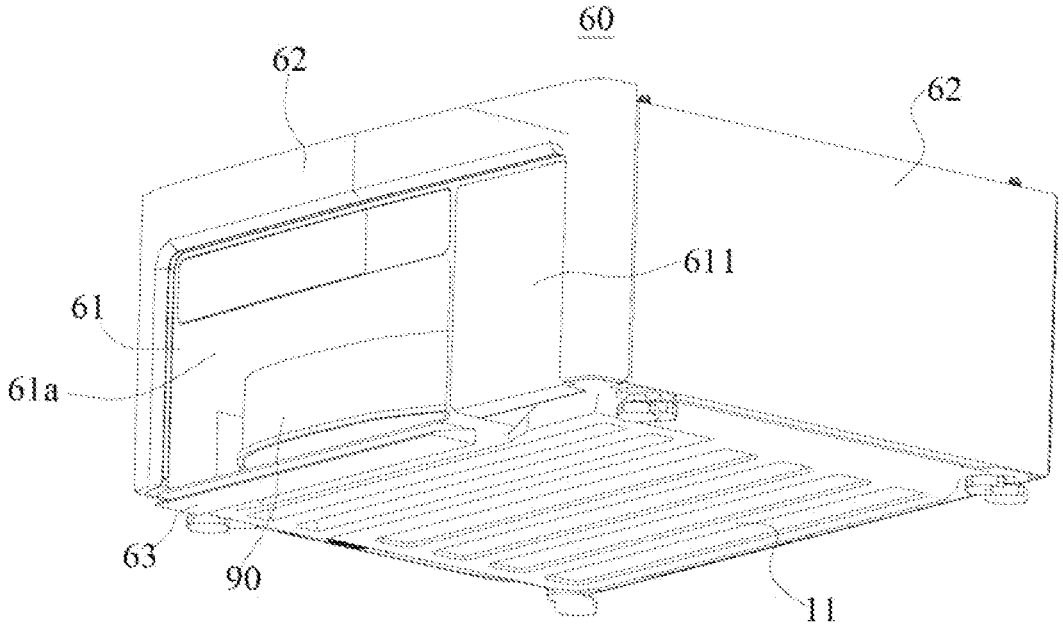
FIG. 13 is a schematic view of the structure shown in FIG. 12 from another perspective.
Figure 14:
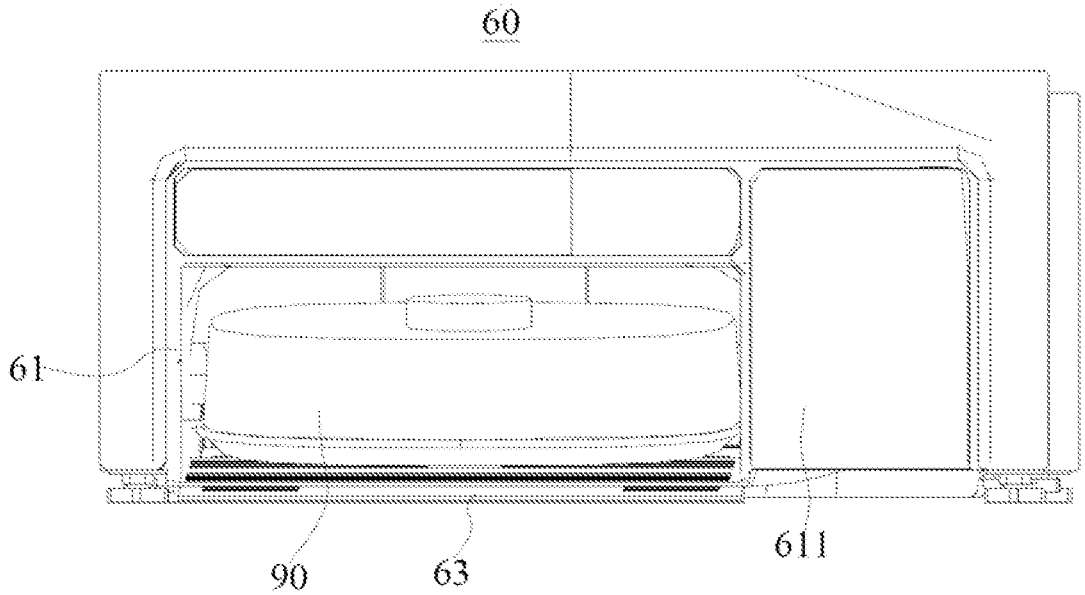
FIG. 14 is a schematic view of the structure shown in FIG. 12 from yet another perspective.

With reference to FIG. 12, FIG. 13 and FIG. 14, an embodiment of the present disclosure provides a base assembly 60. The base assembly 60 includes a pedestal 61 and the base 10 according to any embodiment of the present disclosure, the pedestal 61 is arranged in the accommodation space 10*a*. The pedestal 61 is provided with a receiving cavity 61*a* to accommodate the robot cleaner 90. The base 10 provides a mounting space for the pedestal 61.

An embodiment of the present disclosure provides a laundry treatment device which includes a laundry treatment machine and the base assembly 60 according to any embodiment of the present disclosure. The base assembly 60 is located below the laundry treatment machine, and the base provides support for the laundry treatment machine. Specifically, the laundry treatment machine is supported on the structural support assembly. That is, the structural support assembly is a bearing member which may bear the weight of the laundry treatment machine and its load.

The laundry treatment machine may be in various forms, such as a washing machine, a spin-dryer, a dryer, a washer-dryer, etc. Specific application scenarios of the laundry treatment machine do not form a limitation to the structure of the base assembly 60 of the present disclosure.

In the embodiment of the laundry treatment device of the present disclosure, the base assembly 60 is integrated below the laundry treatment machine. On one hand, the space below the laundry treatment machine may be used to accommodate the robot cleaner 90, so that indoor space occupied by the robot cleaner 90 is reduced. On the other hand, the laundry treatment machine is arranged near a water tap and a floor drain to facilitate the water intake and the discharge, which facilitates the water intake and the discharge of the base assembly 60 through the existing water intake and discharge of the laundry treatment machine, and the water intake and discharge pipelines of the base assembly 60 is simplified.

The robot cleaner 90 may be configured to automatically sweep dust, hair or the like on the floor. In a case that a mop is provided on the robot cleaner 90, the robot cleaner 90 may mop the floor after sweeping.

Functions of the base assembly in the embodiment of the present disclosure provided for the robot cleaner 90 include at least one of charging, dust removal, cleaning, drying or disinfection.

In one example, the robot cleaner 90 includes a first communication component, the base assembly 60 includes a second communication component, and the communication between the robot cleaner 90 and the base assembly 60 can be achieved by the first communication component and the second communication component. For example, when the robot cleaner 90 needs to discharge dust or needs to be charged, the wireless communication can be performed through the first communication component and the second communication component, to allow the robot cleaner to return to the receiving cavity 61*a* of its own accord.

In one example, the first communication component and the second communication component may include, but are not limited to one or more of a Bluetooth component, a Wireless Fidelity (WIFI) component, a 4th Generation/5th Generation (4G/5G) communication component, an infrared component, or other wireless data communication components.

In one example, the base assembly is configured to perform at least one of the charging operations, dust discharge operation, or mop cleaning operation for the robot cleaner 90 after the robot cleaner is stopped in the receiving cavity 61*a*.

With reference to FIG. 12, FIG. 13 and FIG. 14, a front end of a bottom wall of the pedestal 61 is provided with a climbing plate 63 which is configured to guide the robot cleaner 90 to enter or exit the accommodation space.

A rear end of the climbing plate 63 extends into the base 10, a front end of the climbing plate 63 extends outside the front of the base 10, and a front edge of the climbing plate 63 is close to the ground as much as possible, so that the robot cleaner may climb up the climbing plate 63 smoothly.

With reference to FIG. 12, FIG. 13 and FIG. 14, the pedestal 61 is placed on the subbase 11. The subbase 11 plays a role of supporting the pedestal 61 and the robot cleaner stopped in the receiving cavity 61*a*.

Figure 5:
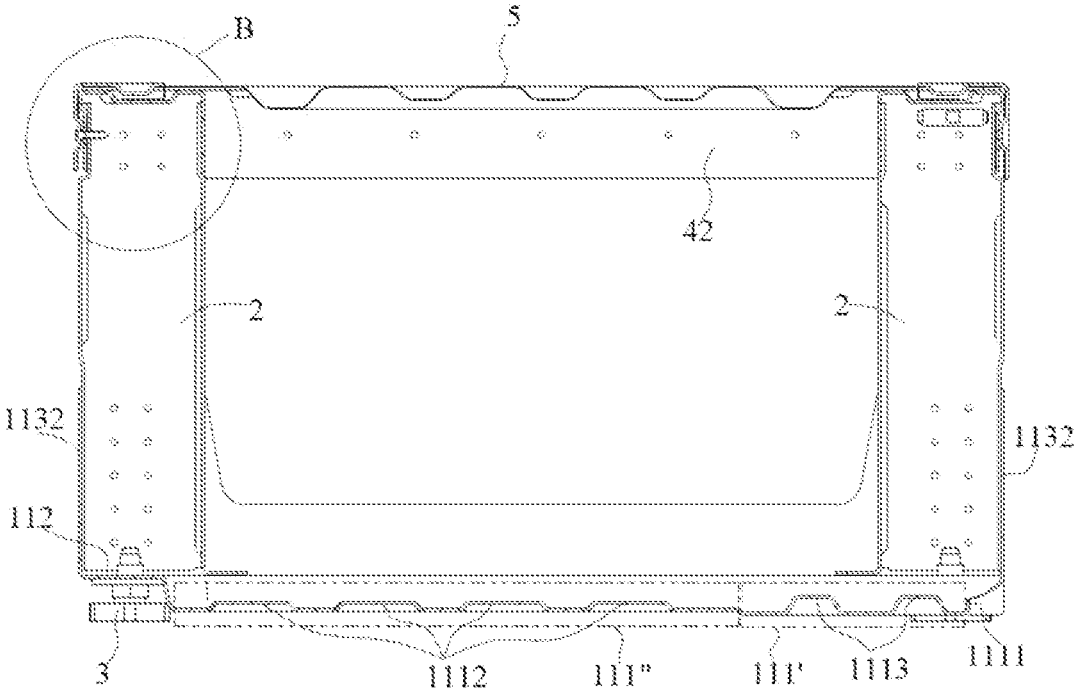
FIG. 5 is a cross-section view taken in A-A direction of FIG. 4.
Figure 7:
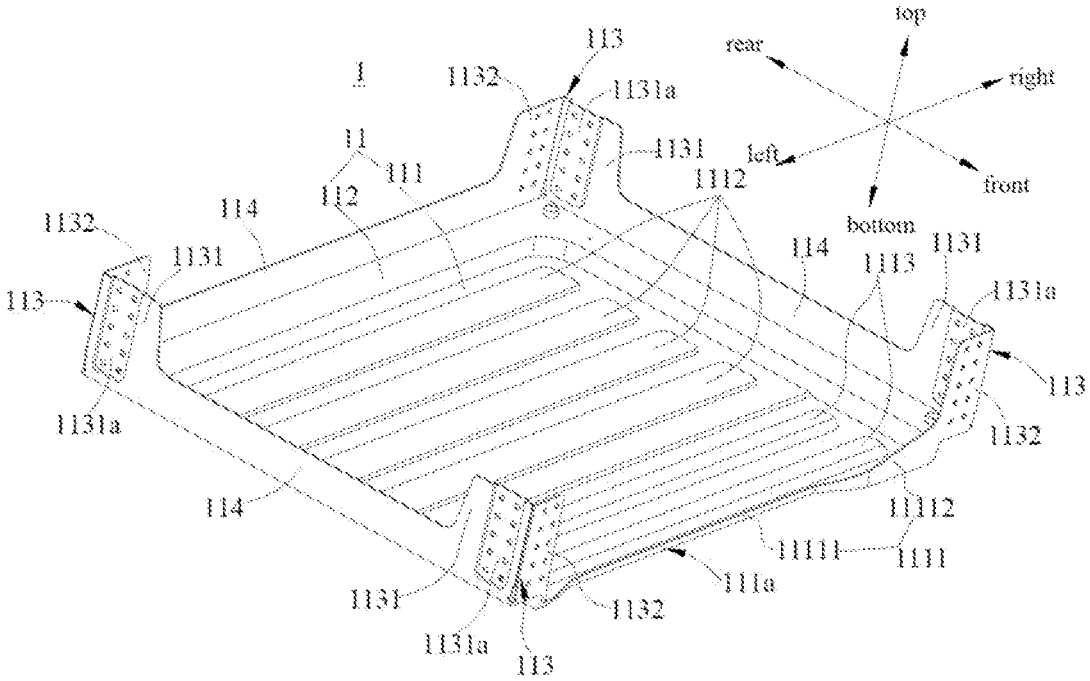
FIG. 7 is a schematic structural view of a bottom plate assembly according to an embodiment of the present disclosure.

With reference to FIG. 5 and FIG. 7, a front edge of the subbase 11 is provided with a flanging 1111 folded upward, the flanging 1111 may enhance structural strength and stiffness at the front edge of the subbase 11, and reduce a probability of cracking of the subbase 11.

Figure 4:
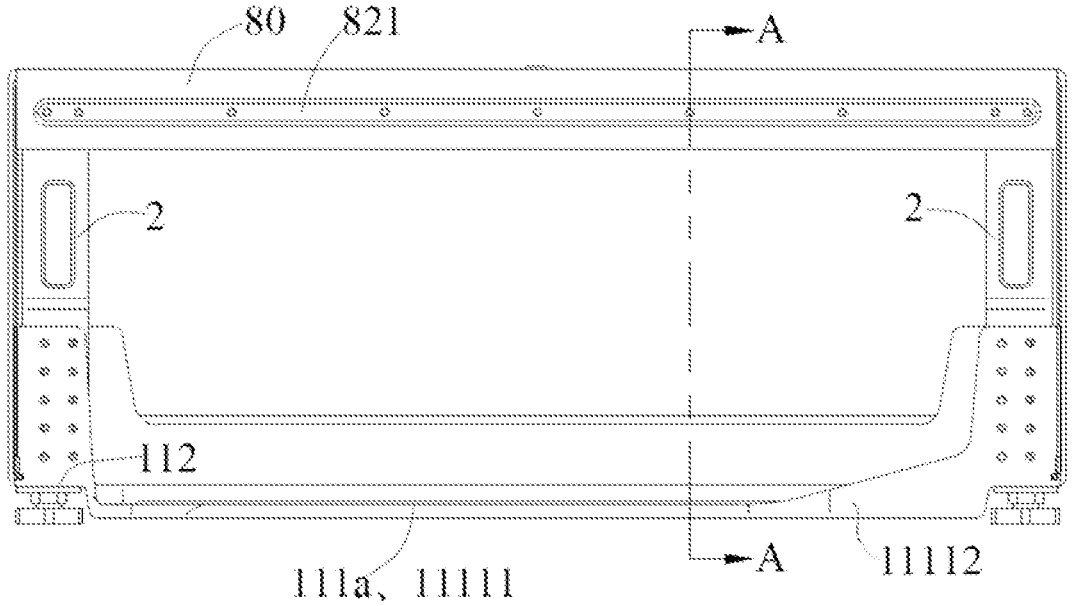
FIG. 4 is a schematic view of the structure shown in FIG. 1 from another perspective.

With reference to FIG. 4, in a width direction of the subbase 11, the flanging 1111 includes an avoidance section 11111 and a heightened section 11112 arranged on a right side of the avoidance section 11111. A height of the heightened section 11112 is higher than that of the avoidance section 11111.

The expression "the height of the heightened section 11112 higher than that of the avoidance section 11111" refers to that a height at a highest position of a top edge of the heightened section 11112 is higher than a height at a highest position of a top edge of the avoidance section 11111.

The climbing plate 63 is arranged above the avoidance section 11111.

According to the embodiment of the base of the present disclosure, the height of the avoidance section 11111 is relatively low, which facilitates the arrangement of the climbing plate 63 to avoid the avoidance section 11111, and facilitates the mounting and the removal of the climbing plate 63. Since the robot cleaner 90 does not need to pass the heightened section 11112 during entering and exiting the receiving cavity 61*a*, the heightened section 11112 may have a higher height to further enhance structural strength of the bottom plate assembly 1.

In one example, the base assembly includes a dust box 611 arranged on a right side of the receiving cavity 61*a*, that is, the receiving cavity 61*a* and the dust box 611 are arranged side by side in a left-right direction. In this way, a height of the base assembly can be reduced. The dust box 611 is arranged above the heightened section 11112.

In one example, the height of the heightened section 11112 is gradually increased in the left-right direction, to increase structural strength of a right end of the heightened section 11112.

In one example, the avoidance section 11111 adopts an equal-height design, that is, a height of each part of the avoidance section 11111 is constant in the left-right direction. In this way, the mounting of the climbing plate is facilitated.

In one example, with reference to FIG. 1 and FIG. 12, the base 10 includes multiple feet 3 arranged below the subbase 11. The entire laundry treatment device is supported on the ground by the feet 3, that is, the feet 3 need to bear weight of the entire laundry treatment device and its load.

Each of the feet 3 may be a fixed foot or an adjustable foot with an adjustable support height, which is not limited here.

In one example, there are four feet 3, each of which is arranged at one of four corners of the subbase 11. The four feet 3 include a left front foot, a right front foot, a left rear foot, and a right rear foot.

In one example, with reference to FIG. 1, FIG. 2, FIG. 3, FIG. 5 and FIG. 7, at least a part of the region of the subbase 11 is recessed downward and forms a sunken bearing region 111 for bearing the pedestal 61. The pedestal 61 is placed in the sunken bearing region 111, that is, the subbase 11 bears weight of the base 61 and the robot cleaner stopped in the receiving cavity 61*a* by the sunken bearing region 111.

A front side edge of the sunken bearing region 111 extends to the access opening 10*b*, the sunken bearing region 111 extends to a front side edge of the subbase 11, and a front side of the sunken bearing region 111 does not have a non-recessed region 112.

According to the embodiment of the base 10 of the present disclosure, the sunken design of the sunken bearing region 111 may play a role of enhancing structural strength and stiffness of the subbase 11. Furthermore, a ground clearance of the sunken bearing region 111 (i.e. the distance between the sunken bearing region and the ground) is less than that of the non-recessed region 112, and the sunken bearing region 111 reduces a mounting height of the bottom wall of the pedestal 61, so that a climbing height for the robot cleaner 90 returning to the pedestal 61 may be reduced, which makes it easier for the robot cleaner to return to the pedestal. In a case that an inclination of the climbing plate 63 is constant, a length of the climbing plate 63 in a front-rear direction may be shortened. This makes it easier to ensure that the climbing plate 63 does not exceed a front side profile of a case 70 of the laundry treatment machine. That is, in a horizontal plane projection viewed from top to bottom of the laundry treatment device, the climbing plate 63 does not exceed a projection range of the case 70 of the laundry treatment machine.

It should be noted that manners of forming the sunken bearing region 111 are not limited. For example, the sunken bearing region 111 is formed by stamping a metal plate through a stamping process. The non-recessed region 112 is a part of the metal plate which is not stamped and bent.

In one example, with reference to FIG. 7, a front edge of the sunken bearing region 111 is folded upward and forms the flanging 1111. That is, the flanging 1111 is arranged at the front edge of the sunken bearing region 111. In this embodiment, structural strength at the front edge of the subbase 11 can be enhanced by the flanging 1111, and the mounting height of the pedestal can be reduced.

With reference to FIG. 2, each foot 3 is connected to the non-recessed region 112 of the subbase 11.

In one example, with reference to FIG. 4, the height of the avoidance section 11111 is lower than the height of the non-recessed region 112 of the subbase 11, and the height of the heightened section 11112 is higher than the height of the non-recessed region 112 of the subbase 11. In this way, it is still possible to facilitate the arrangement of the climbing plate 63 to avoid the avoidance section 11111, and improve the structural strength of the bottom plate assembly 1 by a heightened design of the heightened section 11112.

Figure 8:
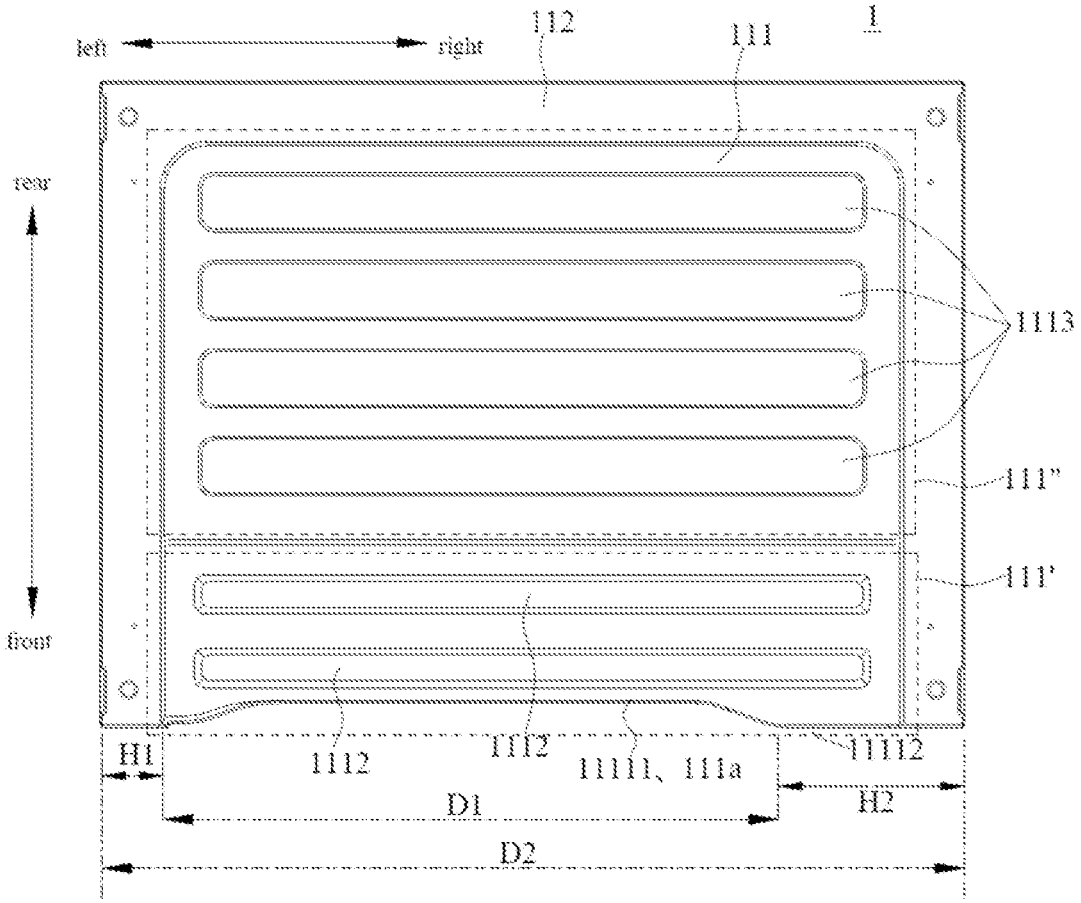
FIG. 8 is a schematic view of the structure shown in FIG. 7 from another perspective.

In one example, with reference to FIG. 8, the avoidance section is concave and forms a recessed front edge 111*a*. It should be noted that a shape of the flanging 1111 is the same as that of the front edge of the sunken bearing region 111. In a downward horizontal plane projection, the projection of the flanging 1111 coincides with the projection of a profile of the front edge of the sunken bearing region 111.

The climbing plate 63 is arranged above the recessed front edge 111*a*. That is, the climbing plate 63 needs to cross the recessed front edge 111*a* from a position above the recessed front edge 111*a*.

In the embodiment of the present disclosure, the recessed front edge 111*a* may play a role of reinforcing the structural strength of the subbase 11.

In the embodiment of the present disclosure, since the climbing plate 63 is inclined at a certain angle, a height of a slope surface of the climbing plate 63 at the position corresponding to the recessed front edge 111*a* is higher, which facilitates the arrangement of the climbing plate 63 to avoid the recessed front edge 111*a* in a height direction, so that size of the climbing plate in the front-rear direction may be reduced on a premise that the climbing plate 63 meets a climbing degree requirement. Specifically, in an alternative embodiment where the front edge of the subbase 11 does not adopt a recessed design, the arrangement of the climbing plate 63 needs to avoid the front edge of the subbase 11 without adopting the recessed design. As such, for the same height of the front edge of the subbase 11, the length of the climbing plate 63 in the front-rear direction should be longer, and the front edge of the climbing plate 63 should extend out of the front edge of the subbase 11 by a longer distance, to meet the climbing degree requirement of the climbing plate.

In one example, a width D1 of the recessed front edge 111*a* is 0.6 to 0.8 of an entire width D2 of the subbase 11, that is, D1=(0.6 to 0.8)*D2. The recessed front edge 111*a* in this size range may also juggle the structural strength of the subbase 11 and a width requirement of the climbing plate 63.

In one example, a distance H1 between a left end of the recessed front edge 111*a* and a left edge of the subbase is less than a distance H2 between a right end of the recessed front edge 111*a* and a right edge of the subbase, that is, H1<H2. That is, the arrangement of the recessed front edge 111*a* is offset to the left. In this way, the climbing plate 63 may be arranged to the left, so as to arrange other structures such as the dust box on the right side of the climbing plate 63.

It should be noted that opposite ends of the flanging 1111 in the left-right direction are connected to the non-recessed region 112 or other parts, such as a first edgefold described below. In this way, it facilitates the flanging 1111 to play a role of reinforcing the structural strength and the stiffness at the front edge of the sunken bearing region 111.

In one example, with reference to FIG. 2 and FIG. 7, the bottom plate assembly 1 includes two first edgefolds 1132 which are folded upward from front edges of non-recessed regions 112 on left and right sides of the sunken bearing region 111. The first edgefolds are configured to be connected to the structural support assembly. A left end of the avoidance section 11111 is connected to the first edgefold 1132 on the left side, and the right end of the heightened section 11112 is connected to the first edgefold 1132 on the right side. In this way, two ends of the flanging 1111 are connected with two first edgefolds 1132 to enhance structural strength of the subbase 11.

In one example, with reference to FIG. 5 and FIG. 7, a part of the sunken bearing region 111 protrudes upward to form reinforcement ribs. The reinforcement ribs may play a role of enhancing the structural strength and the stiffness of the sunken bearing region 111.

Furthermore, since the reinforcement ribs are formed by the part of the sunken bearing region 111 protruding upward, the reinforcement ribs do not affect a ground clearance of the sunken bearing region 111.

In one example, with reference to FIG. 5, FIG. 7 and FIG. 8, the reinforcement ribs are arranged in the left-right direction. Since the robot cleaner 90 moves in the front-rear direction when entering or exiting the station, the reinforcement ribs arranged in the left-right direction may better play a role in enhancing the structural strength and the stiffness.

There may be one or more reinforcement ribs.

In one example, there are multiple reinforcement ribs arranged at intervals in the front-rear direction.

With reference to FIG. 5, FIG. 7 and FIG. 8, each of the reinforcement ribs includes at least one first reinforcement rib 1112 and at least one second reinforcement rib 1113. The at least one first reinforcement rib 1112 is arranged on a front side of each second reinforcement rib 1113. A height of the first reinforcement rib 1112 is higher than that of the second reinforcement rib 1113.

That is, the first reinforcement rib 1112 adopts a heightened design. In this way, the first reinforcement rib 1112 may further enhance the structural strength of a front end of the sunken bearing region 111.

In a specific embodiment, the total number of the reinforcement ribs is six, i.e. two first reinforcement ribs 1112 and four second reinforcement ribs 1113.

In one example, with reference to FIG. 5, the height of the avoidance section 11111 is higher than the height of the second reinforcement ribs 1113 and lower than the height of the first reinforcement ribs 1112. In this way, it facilitates the arrangement of the climbing plate 63 to avoid the avoidance section 11111.

In one example, with reference to FIG. 5 and FIG. 8, the sunken bearing region 111 includes a first sub-region 111' and a second sub-region 111" bordering on each other. The second sub-region 111" is located on a rear side of the first sub-region 111', that is, the first sub-region 111' and the second sub-region 111" are arranged side by side in the front-rear direction.

For example, in FIG. 5 and FIG. 8, two parts of the sunken bearing region 111 in a range of two dashed rectangles are the first sub-region 111' and the second sub-region 111" respectively.

With reference to FIG. 5, a depth of the first sub-region 111' is greater than that of the second sub-region 111". That is, a depth of a part of the sunken bearing region 111 close to the front side is greater than that of a part of the sunken bearing region 111 close to the rear side. In this way, it may play a role of enhancing the structural strength and the stiffness at the front end of the sunken bearing region 111.

In one example, with reference to FIG. 5 and FIG. 8, a part of the first sub-region 111' protrudes upward to form some of the reinforcement ribs, and specifically, the reinforcement ribs in the first sub-region 111' are the first reinforcement ribs 1112. A part of the second sub-region 111" protrudes upward to form the other of the reinforcement ribs, and specifically, the reinforcement ribs in the second sub-region 111" are the second reinforcement ribs 1113.

With reference to FIG. 5, a height of the reinforcement ribs in the first sub-region 111' is higher than that of the reinforcement ribs in the second sub-region 111". That is, the reinforcement ribs in the first sub-region 111' adopt a heightened design, which may further improve the structural strength and the stiffness of the front end of the sunken bearing region 111.

In one example, with reference to FIG. 1, the base 10 includes a cover plate 5 which is arranged on a top side of the structural support assembly and covers the accommodation space 10*a*. When accidents (such as water leakage, water seepage) occur in the laundry treatment machine, dripping water is blocked by the cover plate 5. The cover plate 5 plays a role of waterproof protection for each member on the subbase 61 and may also enhance the structural strength of the structural support assembly.

In some embodiments, a water discharge outlet is arranged on the cover plate 5. The water discharge outlet is configured to direct the water liquid accumulated on the cover plate 5 to the water discharge region of the base assembly 60 where the water liquid is discharged through a water discharge channel of the base assembly 60. In this way, water accumulated on the cover plate 5 is discharged in time, to prevent water liquid overflowing from the cover plate 5 from spreading to the indoor floor.

In one example, with reference to FIG. 1, FIG. 2 and FIG. 3, the structural support assembly includes multiple support pillars 2, a bottom end of each of the support pillars 2 is supported on the non-recessed region 112 of the subbase 11.

The support pillars 2 bear load together, weight of the laundry treatment machine is transmitted to each of the support pillars 2, and each of the support pillars 2 transmits the received force to the foot 3.

In one example, below each of the support pillars 2 a foot 3 is arranged. The load bearing directions of the support pillars 2 and the feet 3 are substantially located on the same vertical line, so that no additional bending moment is generated between the support pillar 2 and the foot 3, and the subbase 11 does not bear a shearing force due to the bending moment. In this way, load bearing conditions of the subbase 11 may be improved, and the thickness requirement and anti-shearing force requirement of the subbase 11 may be reduced.

In one example, in the embodiment of the present disclosure, there are four support pillars 2, and there are four feet 3. In a horizontal plane projection from top to bottom of the laundry treatment device, a projected profile of the base 10 is substantially a quadrilateral, and the feet 3 and the support pillars 2 are located at corners of the projected profile of the base 10.

In one example, the structural support assembly further include multiple cross beams. Top ends of the support pillars 2 are connected to one another through the cross beam. The cross beams may enhance the structural strength and stiffness of the top ends of the support pillars 2, and reduce a probability of lateral deflection of the cross beams.

The term "lateral" refers to any direction in the horizontal plane, such as the left-right direction, the front-rear direction, etc.

Connection manners between the cross beams and the support pillars 2 are not limited.

In one example, top ends of the support pillars 2 are connected to one another by the cross beams, to form a frame structure. In the embodiment where the cover plate 5 is provided, the cover plate 5 is arranged in a region surrounded by the cross beams, and the cover plate 5 is connected to the cross beams.

For example, in an embodiment where there are four support pillars 2, a number of the cross beams is four, and the four cross beams are connected sequentially to one another to form a substantially quadrilateral configuration.

In one example, with reference to FIG. 7, the bottom plate assembly 1 includes multiple edgefold sets 113 each bent upward from an edge of the non-recessed region 112. Each of the edgefold sets 113 includes a second edgefold 1131 and a first edgefold 1132. With reference to FIG. 2, an outer side of each support pillar 2 in the left-right direction is in close contact with and fixedly connected to at least a part of region of the second edgefold 1131, and an outer side of the support pillar 2 in the front-rear direction is in close contact with and fixedly connected to at least a part of region of the first edgefold 1132.

In the embodiment, the connection manner between the edgefold set 113 and the support pillar 2 enhance the lateral stiffness of the support pillar 2, reduce or prevent stress concentration at a bottom edge of the support pillar 2, and improve connection reliability between the support pillar 2 and the bottom plate assembly 1.

For example, in an embodiment where four support pillars 2 are provided, a number of edgefold sets is four, and each of the support pillars 2 is connected to one edgefold set.

Specifically, in each of the edgefold sets 113, a plate surface of the second edgefold 1131 substantially faces toward the left-right direction, a plate surface of the first edgefold 1132 substantially faces toward the front-rear direction, and the second edgefold 1131 and the first edgefold 1132 are substantially arranged at 90 degrees to form a right angle facing toward the accommodation space 10*a*. The four edgefold sets 113 substantially form four right angles, and at each of the right angles one support pillar 2 is mounted.

It may be understood that angle between the second edgefold 1131 and the first edgefold 1132 may vary according to the shape of the support pillars 2, for example, the angles between the second edgefold 1131 and the first edgefold 1132 may range from 80° to 120°.

In one example, with reference to FIG. 7, a part of the second edgefold 1131 is recessed toward a side of the accommodation space 10*a*, and forms a mounting avoidance region 1131*a* in close contact with the support pillars 2. A fastener passes through the mounting avoidance region 1131*a* and the support pillar 2 sequentially.

The fastener may be a screw or a bolt.

After assembly, a nut of the fastener is located in a recessed space of the mounting avoidance region 1131*a*, so that the nut of the fastener does not protrude beyond an outer surface of the second edgefold 1131. Therefore, it facilitates arrangement of a decorative case 62 at the outer side, and the nut of the fastener does not interfere with the decorative case 62.

In one example, with reference to FIG. 7, the bottom plate assembly 1 includes multiple connection edgefolds 114 each bent upward from an edge of the non-recessed region 112. Two second edgefolds 1131 on the same side are connected to one another by one connection edgefold 114, and two first edgefolds 1132 on the rear side are connected to one another by another one of the connection edgefolds 114.

The connection edgefolds 114 may enhance the structural strength of two second edgefolds 1131 or two first edgefolds 1132 connected to the connection edgefolds.

In one example, a height of the second edgefold 1131 and a height of the first edgefold 1132 are higher than that of the connection edgefold 114. The amount of material used and the weight of the base may be reduced while meeting structural strength requirements.

In one example, the height of the avoidance section 11111 is lower than that of the connection edgefolds 114.

The height of the avoidance section 11111 lower than that of the connection edgefold 114, refers to that a height at a highest position of a top edge of the connection edgefold 114 is higher than the height at the highest position of the top edge of the avoidance section 11111.

In one example, the bottom plate assembly 1 is a one-piece sheet metal part. That is, the bottom plate assembly 1 is a structure obtained by cold processing of a single metal plate, such as a structure obtained after blanking, stamping, bending or other processes. In this way, the structural strength and the stiffness of the bottom plate assembly 1 may be improved.

In some specific embodiments, the single metal plate is cut by a blanking process to form a desired shape. After cutting of the metal plate, stamping is performed to the plate, to form the sunken bearing region 111. Then, edge parts of the plate are bent by a bending process, to form the second edgefold 1131, the first edgefold 1132 and the connection edgefold 114 as described above. A part of the plate which is not stamped or bent is the non-recessed region 112, that is, the non-recessed region 112 is equivalent to a reference basis for performing stamping, bending and other processes on the plate.

A specific shape of the support pillar 2 is not limited. In one example, with reference to FIG. 1, FIG. 2 and FIG. 3, a horizontal cross-section shape of the support pillar 2 is substantially a "U" shape, and an opening of the "U" shape faces toward the accommodation space 10*a* in the left-right direction. For example, openings of "U" shapes of two support pillars 2 on the right side face toward the left side, and openings of "U" shapes of two support pillars 2 on the left side face toward the right side.

In one example, two support pillars 2 on the same side and the cross beam between said two support pillars are configured as a sheet metal frame formed by bending a single metal plate several times. The whole sheet metal frame presents a "U" shape, and an opening of the "U" shape is oriented. The same side refers to the same side in the left-right direction or the front-rear direction. In this way, the structural strength and bearing capacity of the structural support assembly may be improved.

For example, in some embodiments, two support pillars 2 on the same side in the left-right direction and the cross beam between said two the support pillars are configured as a sheet metal frame formed by bending the single metal plate several times. Specifically, a support pillar 2 on the left front side, a support pillar 2 on the left rear side and a cross beam on the left side are formed by bending a metal plate several times, to form a sheet metal frame. A support pillar 2 on the right front side, a support pillar 2 on the right rear side and a cross beam on the right side are formed by bending another metal plate several times, to form another sheet metal frame. A cross beam on the rear side is connected between rear ends of the two sheet metal frames, and a cross beam on the front side is connected between the front ends of the two sheet metal frames.

In some other embodiments, with reference to FIG. 3, two support pillars 2 on the same side in the front-rear direction and the cross beam between said two support pillars are configured as a sheet metal frame formed by bending a single metal plate several times. Specifically, a support pillar 2 on the left front side, a support pillar 2 on the right front side and a cross beam on the front side are formed by bending a metal plate several times, to form a sheet metal frame. A support pillar 2 on the right rear side, a support pillar 2 on the left rear side and a cross beam on the rear side are formed by bending another metal plate several times, to form another sheet metal frame. A cross beam on the left side is connected between left ends of the two sheet metal frames, and a cross beam on the right side is connected between right ends of the two sheet metal frames.

For convenience of descriptions, cross beams for forming the sheet metal frame are referred to as first cross beams 41, and cross beams configured to connect two sheet metal frames are referred to as second cross beams 42. That is, the structural support assembly of the embodiment of the present disclosure includes at least two first beams 41 and at least two second beams 42.

A cross-section shape of the first cross beam 41 is substantially a "U" shape.

Figure 10:
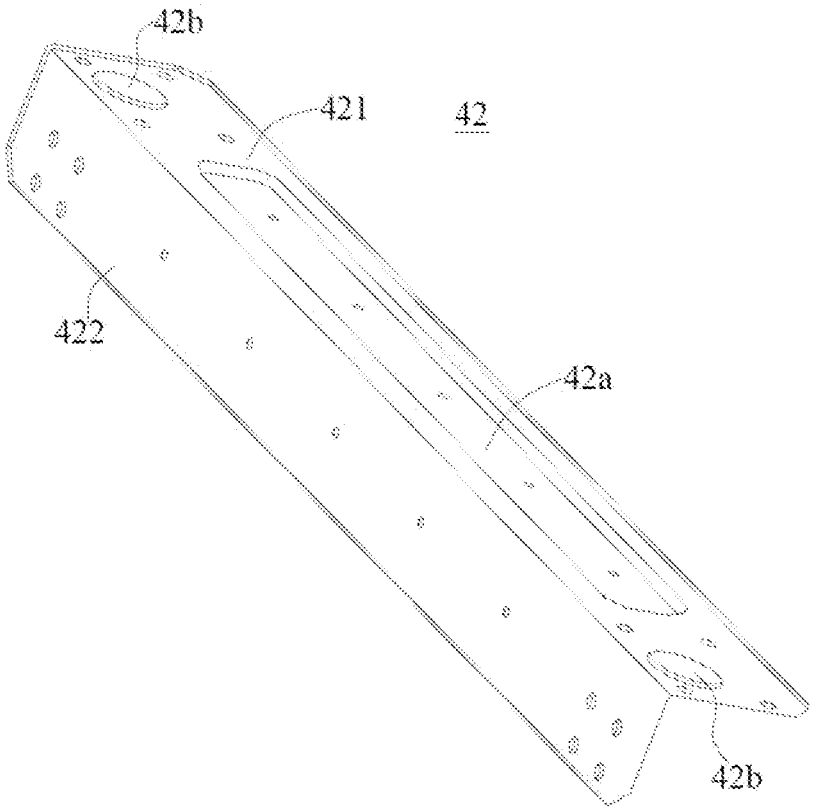
FIG. 10 is a schematic structural view of a second cross beam according to an embodiment of the present disclosure.

In one example, with reference to FIG. 10, the second cross beam 42 includes a first sub-plate 421 and a second sub-plate 422 arranged at a bottom side edge of the first sub-plate 421.

An angle between the first sub-plate 421 and the second sub-plate 422 is substantially a right angle, that is, a shape of a cross section of the second cross beam 42 in a direction perpendicular to a length direction thereof is substantially an "L" shape.

Opposite ends of the first sub-plate 421 in the length direction rest on an upper surface of the second cross beam 42, and the second sub-plate 422 is in close contact with a side surface of an upper end of the support pillar 2.

In one example, with reference to FIG. 10, a part of the first sub-plate 421 of the second cross beam 42 is recessed downward and forms a sunken groove 42*a* which extends in the length direction of the first sub-plate 421. Positioning holes 42*b* are provided at opposite ends of the second cross beam 42 in the length direction, and the sunken groove 42*a* is located between two positioning holes 42*b*.

Figure 11:
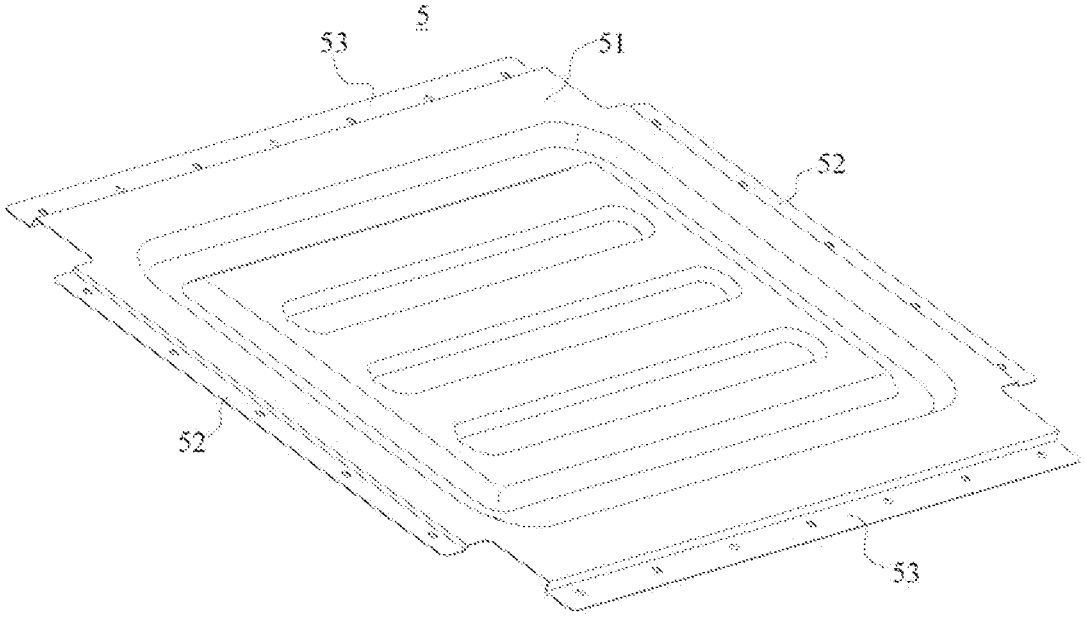
FIG. 11 is a schematic structural view of a cover plate according to an embodiment of the present disclosure.

In one example, with reference to FIG. 11, the cover plate 5 includes a body 51, first side parts 52 arranged at opposite side edges of the body 51 close to the second cross beam 42, and second side parts 53 arranged at opposite side edges of the body 51 close to the first cross beam 41.

The body 51 covers the accommodation space 10*a*. Each of the first side part 52 and the second side part 53 is sunken from edges of the body 51. That is, a height of the first side part 52 and a height of the second side part 53 are lower than that of the body 51. The first side part 52 is sunken so that the first side part 52 and the body 51 are located in different planes, which may enhance the structural strength of the cover plate 5.

Figure 6:
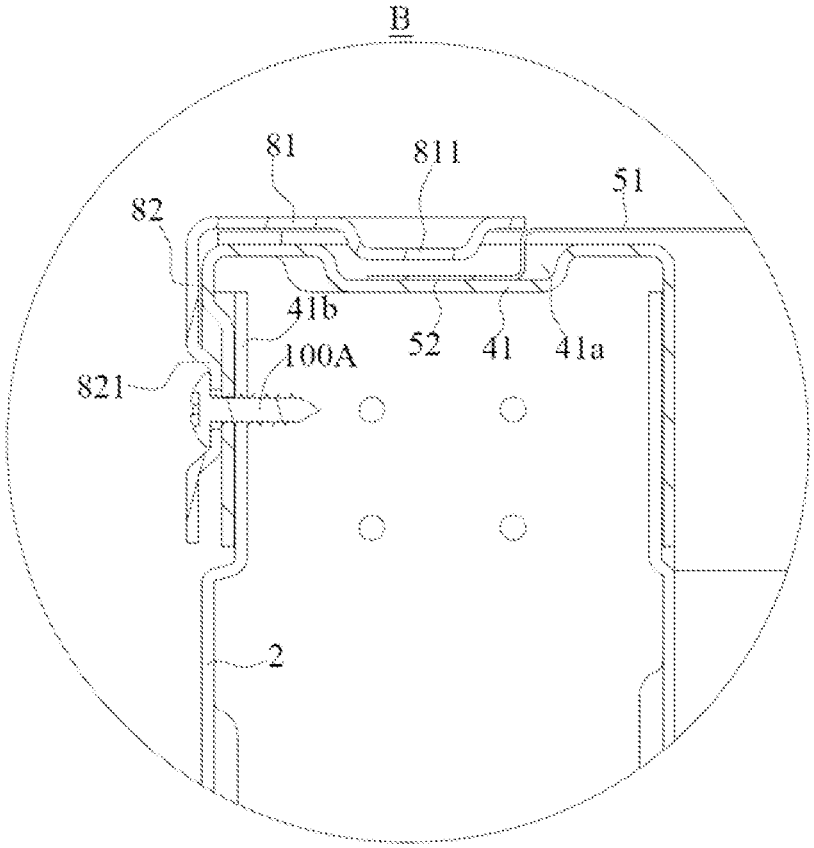
FIG. 6 is a partially enlarged schematic view at B of FIG. 5.

With reference to FIG. 6, the first side part 52 is accommodated in the sunken groove 42*a*. A screw passes through the first side part 52 and the second cross beam 42 from top to bottom, to fix the cover plate 5 to the second cross beam 42.

The sunken groove 42*a* provides a receiving cavity 61*a* for the first side part 52 and a nut of the screw, to prevent the first side part 52 and the nut of the fastener from protruding beyond an upper surface of the first sub-plate 421 of the second cross beam 42.

A sunken depth of the second side part 53 is greater than that of the first side part 52, that is, a height of the second side part 53 is lower than that of the first side part 52. With reference to FIG. 1, the second side part 53 rests on an inner side edge of a top surface of the second cross beam 42. In this way, all four sides of the cover plate 5 may be supported, and load bearing conditions are better.

Figure 15:
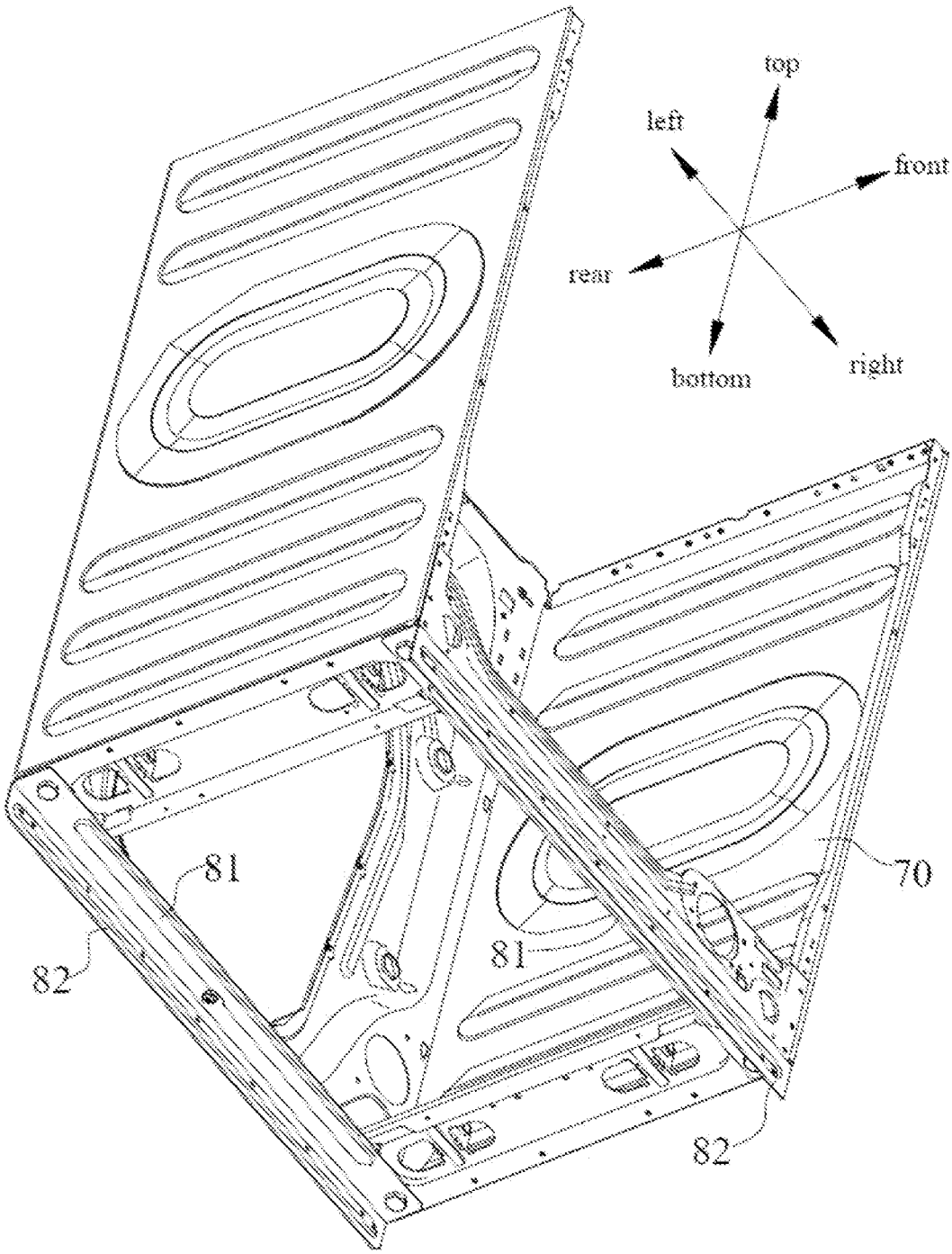
FIG. 15 is a schematic view of cooperation between a box body and a connection plate according to an embodiment of the present disclosure.
Figure 16:
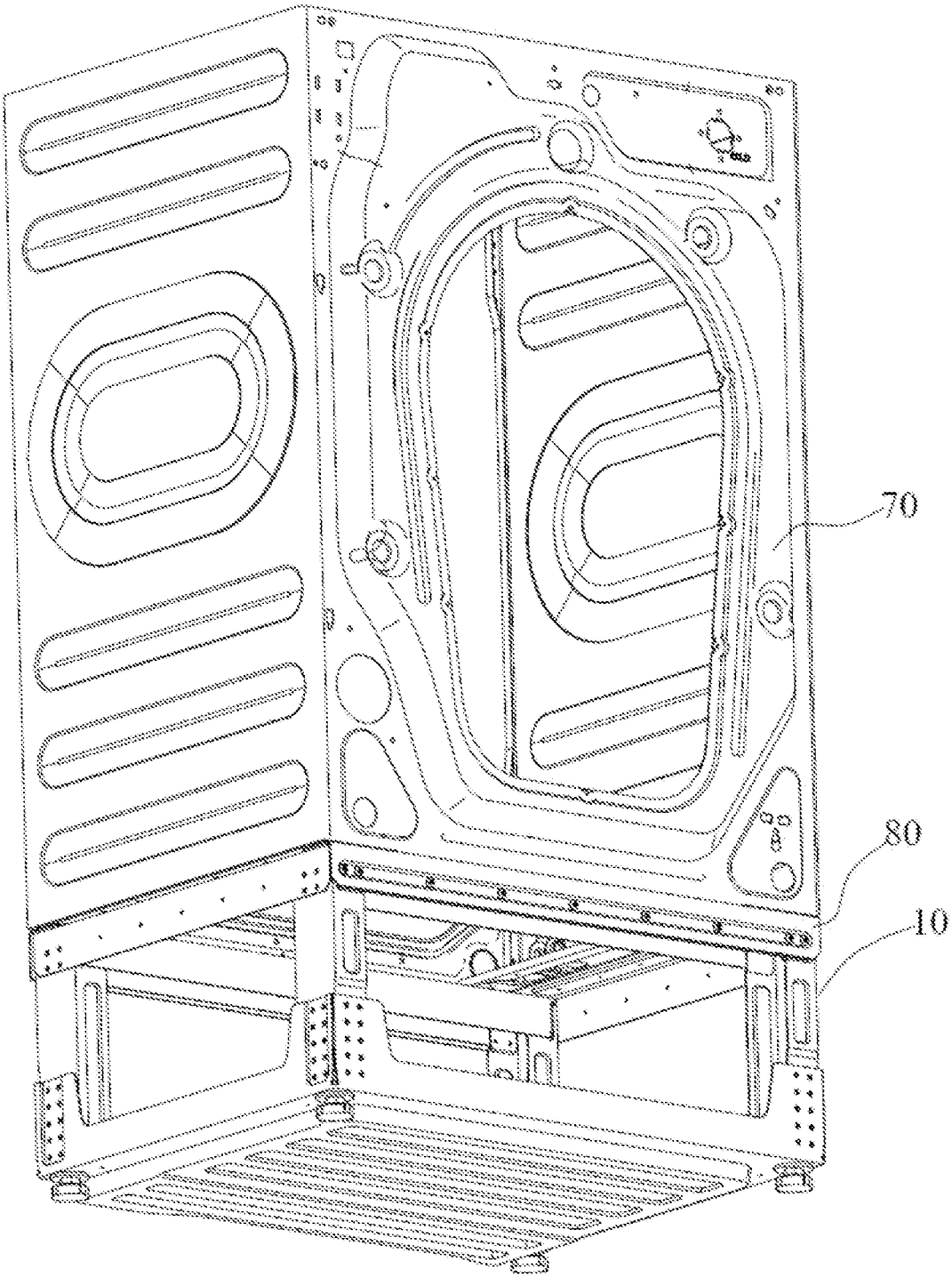
FIG. 16 is a schematic view of assembly between the structure shown in FIG. 15 and the structure shown in FIG. 2.
Figure 17:
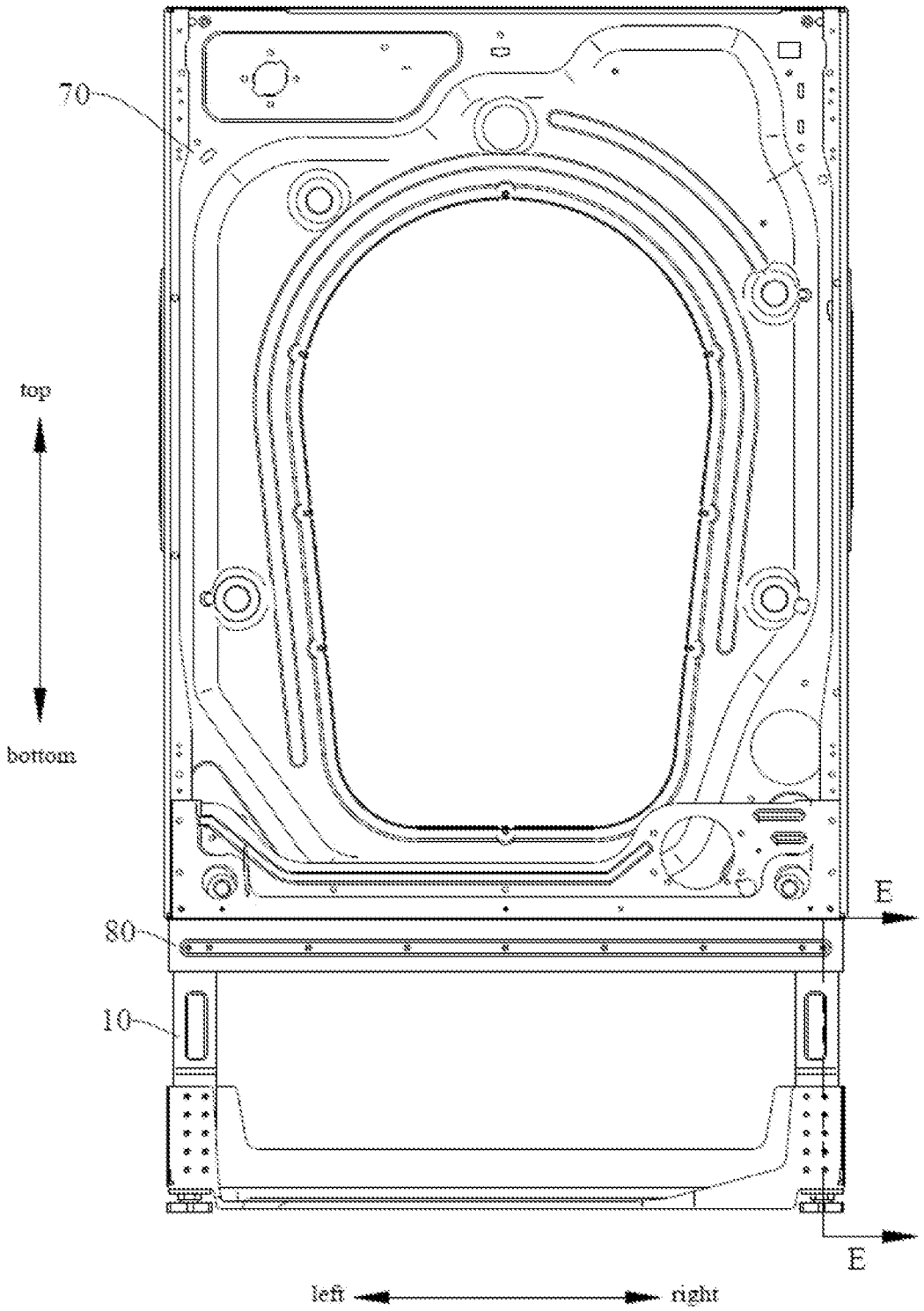
FIG. 17 is a schematic view of the structure shown in FIG. 16 from another perspective.

With reference to FIG. 15, the laundry treatment machine includes a case 70 and a connection plate 80 arranged below the case 70. A screw connector 100B (a screw or a bolt) passes through the connection plate 80 and a bottom wall of the case 70 from bottom to top, to fix the connection plate 80 to bottom of the case 70.

The laundry treatment machine is connected to the base 10 through the connection plate 80.

In one example, a bottom end of the screw connector 100B is insisted in the positioning hole 42*b* and passes through the positioning hole 42*b*, and opposite ends of the connection plate 80 in the length direction are connected to the support pillars 2.

The shape of the positioning hole 42*b* is not limited. In one example, the shape of the positioning hole 42*b* includes, but is not limited to a circular shape, an elliptical shape, a polygonal shape, etc.

Figure 18:
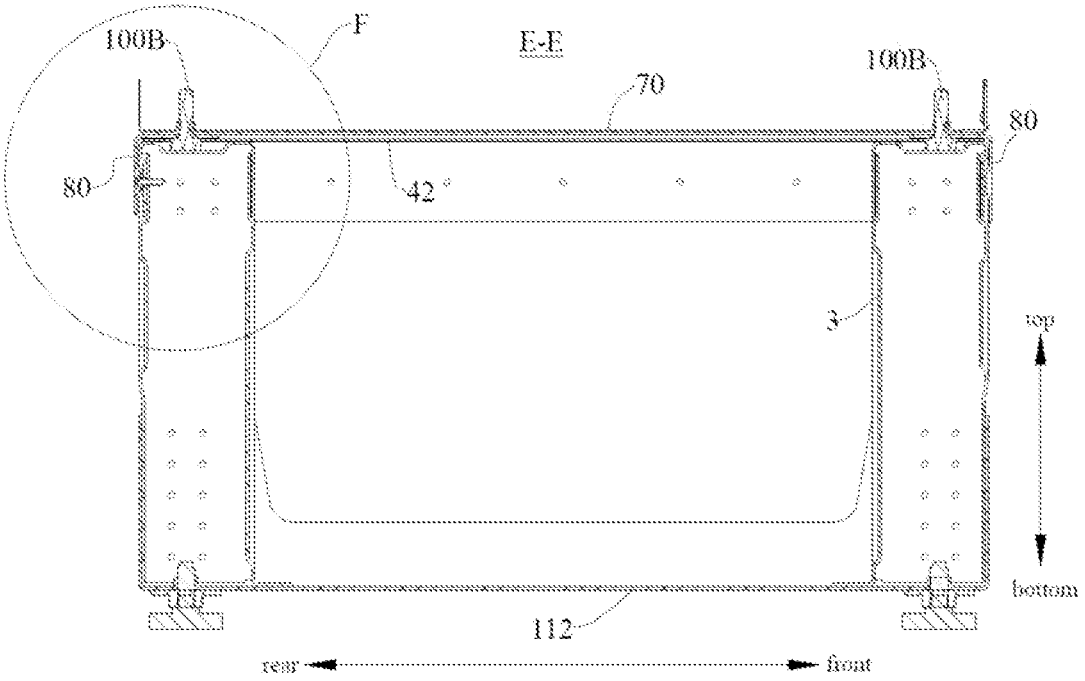
FIG. 18 is a cross-section view taken in E-E direction of FIG. 17.
Figure 19:
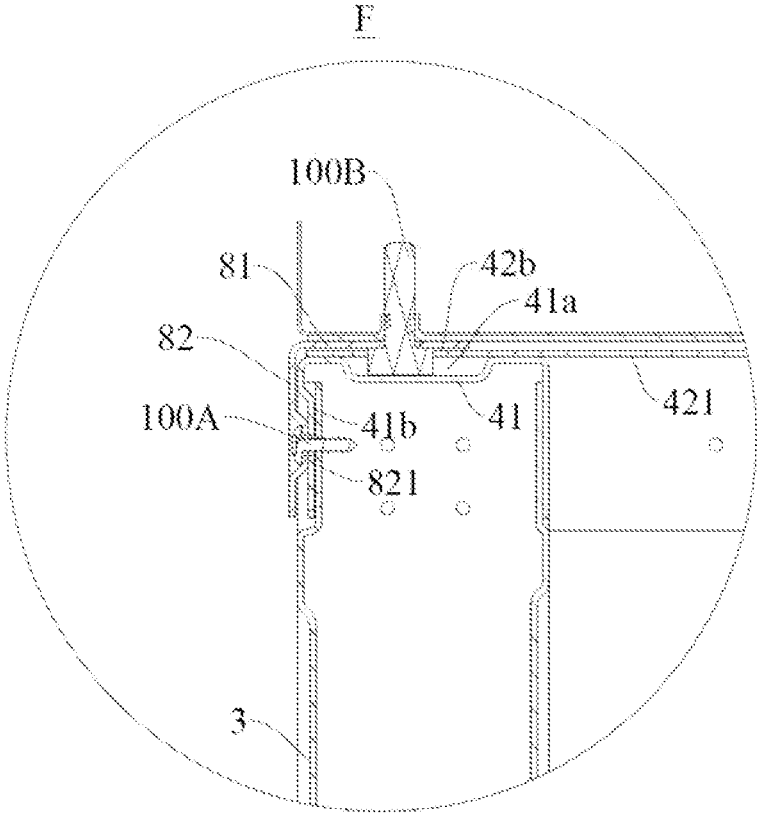
FIG. 19 is a partially enlarged schematic view at F of FIG. 18.

With reference to FIG. 2, a part of a top wall of the first cross beam 41 is recessed downward and forms an accommodation groove 41*a*, the accommodation groove 41*a* extends in the length direction of the first cross beam 41 and extends to a position below the positioning hole 42*b*. With reference to FIG. 18 and FIG. 19, the nut of the screw connector is located in the accommodation groove 41*a*.

The accommodation groove 41*a* may enhance structural strength of the second cross beam 42, and may also prevent the arrangement of the nut of the screw connector from increasing a distance between the case 70 and the base 10, so that the connection plate 80 may be in close contact with an upper surface of the first cross beam 41. In this way, the laundry treatment device may have a small overall height, and the case 70 may be supported on the base 10 more firmly.

Figure 9:
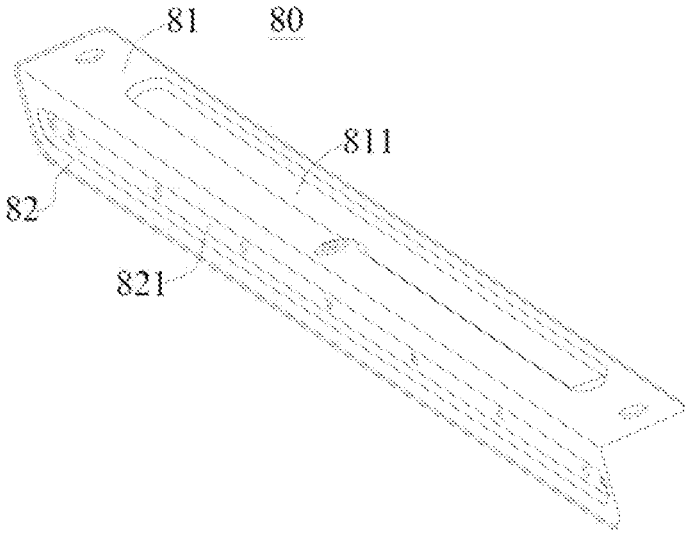
FIG. 9 is a schematic structural view of a connection plate according to an embodiment of the present disclosure.

In one example, with reference to FIG. 9, the connection plate 80 includes a first connection sub-plate 81 and a second connection sub-plate 82. With reference to FIG. 6, FIG. 18 and FIG. 19, the first connection sub-plate 81 is in close contact with the bottom wall of the case 70, and the second connection sub-plate 82 is bent downward from an edge of the first connection sub-plate 81.

An angle between the first connection sub-plate 81 and the second connection sub-plate 82 is substantially a right angle. A shape of a cross section of the connection plate 80 in a direction perpendicular to a length direction thereof is an "L" shape, which is simple in structure and low in cost.

The connection plate 80 may be made of metal, and the connection plate 80 is of a sheet metal structure. In this way, the connection plate 80 has good structural strength and is simple to manufacture.

With reference to FIG. 6, the second connection sub-plate 82 is located on a lateral outer side of the first cross beam 41. Two ends of the second connection sub-plate 82 are located on a lateral outer side of the support pillar 2, and a screw passes through the second connection sub-plate 82, the first cross beam 41 and the support pillar 2 to fix the second connection sub-plate 82 to the support pillar 2.

During the assembly of the laundry treatment machine and the base 10, a screw connector passes through the first connection sub-plate 81 and the bottom wall of the case 70 from a bottom side of the case 70, to connect the connection plate 80 and the case 70 together as an integral structure. The nut of the screw connector is located on the bottom side of the case 70.

Then, the above integral structure is placed on the base 10, and the bottom end of the screw connector is inserted into the positioning hole 42*b* and the accommodation groove 41*a*, to achieve rough positioning of the integral structure with respect to the base 10 and prevent occurrence of deviation and dislocation of the integral structure. Then, the second connection sub-plate 82 is firmly connected to the support pillar 2.

In one example, with reference to FIG. 5, FIG. 6 and FIG. 9, a part of the first connection sub-plate 81 is recessed downward and forms a first recessed part 811 which extends in a length direction of the first connection sub-plate 81. The first recessed part 811 extends into the above accommodation groove 41*a*. The accommodation groove 41*a* plays a role of receiving the first recessed part 811. The first recessed part 811 is nested in the accommodation groove 41*a*, and the accommodation groove 41*a* limits lateral slippage of the first connection sub-plate 81 in a direction perpendicular to the length direction thereof, thereby play a role of limiting the position of the first connection sub-plate 81.

In one example, with reference to FIG. 5, FIG. 6, FIG. 9 and FIG. 19, a part of the second connection sub-plate 82 is recessed inward and forms a second recessed part 821 which extends in a length direction of the second connection sub-plate 82. A screw 100A passes through the second recessed part 821 and is connected to the support pillar 2. An outer surface of the second recessed part 821 plays a role of accommodating a nut of the screw 100A, to prevent the nut from protruding beyond an outer surface of the second connection sub-plate 82.

In some embodiments, with reference to FIG. 6 and FIG. 19, a part of the upper end of the support pillar 2 is recessed inward, and a lateral outer side wall of the first cross beam 41 is recessed inward and forms a recessed edge 41*b* which provides an avoidance space for the second recessed part 821.

In an embodiment, a bottom wall of the subbase 61 is provided with a cleaning groove for cleaning the cleaning parts of the robot cleaner such as a mop. The cleaning parts can be cleaned by water and liquid in the cleaning groove without user's manual cleaning, thus achieving a good user experience.

In an embodiment, the base assembly includes a water inlet valve and a water inlet pipeline. The water inlet pipeline is in communication with the cleaning groove, and the water inlet valve is arranged in the water inlet pipeline. The water inlet pipeline is configured to supply water to the cleaning groove. The water inlet valve is configured to close or open the water inlet pipeline. Opening and closing of the water inlet valve may be controlled by a controller, to achieve automatic water input of the cleaning groove. A water flow of the cleaning groove may be independently controlled by the water inlet valve, and is not affected by water used by the laundry treatment machine, what need to do only is to electrify the water inlet valve. In this way, the water inlet valve may operate independently even though the laundry treatment machine is not electrified. Similarly, a water flow of the laundry treatment machine may be independently controlled and is not affected by water used by the pedestal.

In an embodiment, the water inlet pipeline is connected with a tap water pipe. On one hand, the tap water pipe continuously supply tap water to the cleaning groove. In this way, a water tank or other structures for supplying water to the cleaning groove can be eliminated.

In an embodiment, the base assembly includes a water discharge channel and a water discharge pump, the water discharge channel is connected with the cleaning groove and the floor drain, and the water discharge pump is arranged in the water discharge channel to pump sewage in the cleaning groove to the floor drain. Start and stop of the water discharge pump may be controlled by the controller, to achieve automatic sewage discharge of the cleaning groove.

In one example, the water discharge passage and the water discharge pipe of the laundry treatment machine may be connected to one another through a three-way valve to share the floor drain. That is, washing water from the laundry treatment machine and cleaning water in the cleaning groove may be discharged to a sewer through the same floor drain, and it is unnecessary to provide floor drains for washing water and cleaning water respectively, thereby saving structural parts.

In an embodiment, the base assembly includes a detergent bottle which is in communication with the cleaning groove and arranged on the pedestal. The detergent bottle is configured to distribute the detergent to the cleaning groove, which may clean the cleaning parts better.

In some embodiments, the detergent bottle may be a disposable device, and after detergent in the detergent bottle is used up, the detergent bottle may be taken out and replaced with a new detergent bottle. In some other embodiments, the user may fill detergent into the detergent bottle, and the detergent bottle may be reused, thereby achieving energy conservation and environment protection.

In an embodiment, the base assembly includes a feeding pump which is arranged on the pedestal and configured to pump detergent in the detergent bottle to the cleaning groove. The detergent is pumped by the feeding pump to achieve autonomous, quantitative and accurate feeding of detergent, thereby improving a degree of automation.

In an embodiment, the base assembly includes a charging terminal and a power supply component electrically connected to the charging terminal, the charging terminal is arranged on a peripheral surface of the receiving cavity 61*a*. When the robot cleaner is located in the receiving cavity 61*a*, the robot cleaner may be electrically connected to the charging terminal, to allow the robot cleaner to be charged. The power supply component is configured to convert alternating current (AC) power of an electric supply into direct current (DC) power, and the charging terminal uses the DC power to charge the robot cleaner.

In an embodiment, the base assembly includes a controller arranged on the pedestal. The controller is configured to electrically control electrical devices cooperating with the robot cleaner such as the water inlet valve, the feeding pump, etc. In this way, the electrical devices cooperating with the robot cleaner may be independently controlled and are not affected by electrical devices used for the laundry treatment. The electrical devices can be controlled as long as the controller is powered by the power supply. In this way, the electrical devices cooperating with the robot cleaner may operate independently even though the electrical devices used for the laundry treatment are not powered and do not operate.

In an embodiment, the base assembly may include a fan and a drying duct arranged on the pedestal. The drying duct connects the fan with the receiving cavity 61*a*. The fan ventilates the receiving cavity 61*a* through the drying duct, to quickly dry the cleaning parts of the robot cleaner.

In descriptions of the present disclosure, descriptions of reference terms "an embodiment," "some embodiments," "example," "specific example," or "some examples" or the like mean that specific features, structures, materials or characteristics described in combination with the embodiment or example are included in at least one embodiment or example of the embodiments of the present disclosure. In the present disclosure, schematic expressions of the above terms are not necessarily directed to the same embodiment or example. Furthermore, the described specific features, structures, materials or characteristics may be combined in a suitable manner in any one or more embodiments or examples. Furthermore, those skilled in the art may combine different embodiments or examples described in the present disclosure and features of different embodiments or examples, without conflict with each other.

The above descriptions are only preferred embodiments of the present disclosure and are not intended to limit the present disclosure. The present disclosure may be subjected to various changes and variations by those skilled in the art. Any modification, equivalent replacement, improvement, or the like made within the spirit and principle of the present disclosure should be included in the scope of protection of the present disclosure.

The invention claimed is:

1. A base comprising:

a bottom plate assembly including a subbase and a plurality of edgefold sets, each of the plurality of edgefold sets being bent upward from an edge of the subbase, a front edge of the subbase including a flanging folded upward and including an avoidance section, and a climbing plate being arranged above the avoidance section; and a structural support assembly arranged above the bottom plate and forming an accommodation space above the subbase, an access opening being provided on a front side of the accommodation space, the structural support assembly including a plurality of support pillars, and each of the plurality of support pillars being fixedly connected to a part of one of the plurality of edgefold sets.

2. The base of claim 1, wherein the avoidance section is configured to have a constant height in a length direction of the flanging.

3. The base of claim 1, wherein the avoidance section is concave and forms a recessed front edge.

4. The base of claim 1, wherein in a direction in which the avoidance section is provided, the flanging further includes a heightened section arranged on one side of the avoidance section, and a height of the heightened section is higher than a height of the avoidance section.

5. The base of claim 1, wherein at least a part of the subbase is recessed downward and forms a sunken bearing region, and a front edge of the sunken bearing region is folded upward and forms the flanging.

6. The base of claim 5, wherein a height of the avoidance section is lower than a height of a non-recessed region of the subbase.

7. The base of claim 6, wherein a ground clearance of the sunken bearing region is less than a ground clearance of the non-recessed region, and the sunken bearing region is configured to bear a pedestal.

8. The base of claim 5, wherein a part of the sunken bearing region protrudes upward to form at least one reinforcement rib, a height of each of the at least one reinforcement rib is lower than a height of a non-recessed region of the subbase.

9. The base of claim 8, wherein:

the at least one reinforcement rib includes a plurality of reinforcement ribs arranged at intervals;

each of the reinforcement ribs includes a first reinforcement rib and a second reinforcement rib, and a height of the first reinforcement rib is higher than a height the second reinforcement rib; and a height of the avoidance section is higher than the height of the second reinforcement rib and lower than the height of the first reinforcement rib.

10. The base of claim 1, wherein the structural support assembly further includes a plurality of cross beams, and each of the cross beams connects top ends of at least two of the plurality of support pillars.

11. The base of claim 10, wherein two support pillars on a same side and the corresponding cross beam between the two support pillars are configured as a sheet metal frame formed by bending a same metal plate.

12. The base of claim 1, wherein:

each of the plurality of edgefold sets includes a first edgefold and a second edgefold;

a first outer side of each of the plurality of support pillars is in close contact with and fixedly connected to at least a part of the second edgefold; and a second outer side of each of the plurality of support pillars is in close contact with and fixedly connected to at least a part of the first edgefold.

13. The base of claim 12, wherein:

the bottom plate assembly further includes a plurality of connection edgefolds bent upward from the edge of the non-recessed region;

two second edgefolds on a same side are connected to one another by one of the connection edgefolds;

two first edgefolds on a rear side are connected to one another by another one of the connection edgefolds; and a height of the avoidance section is lower than a height of each of the connection edgefolds.

14. The base of claim 12, wherein a part of the second edgefold is recessed toward a side of the accommodation space and forms a mounting avoidance region which is in close contact with one support pillar of the plurality of support pillars, and a fastener passes through the mounting avoidance region and the one support pillar.

15. The base of claim 1, wherein the base satisfies at least one of:

the bottom plate assembly being a one-piece sheet metal part; or the base further comprising a cover plate arranged on a top side of the structural support assembly and covering the accommodation space.

16. A base assembly comprising:

the base according to claim 1; and a pedestal arranged in the accommodation space and provided with a receiving cavity, the climbing plate being provided at a front end of a bottom wall of the pedestal.

17. The base assembly of claim 16, further comprising:

a dust box arranged on a right side of the receiving cavity and located on a right side of the climbing plate.

18. A laundry treatment device comprising:

the base assembly according to claim 16; and a laundry treatment machine supported on the structural support assembly.

19. A base comprising:

a bottom plate assembly including a subbase and two edgefolds, a front edge of the subbase including a flanging folded upward, the flanging including an avoidance section and a heightened section, a height of the heightened section being higher than a height of the avoidance section and lower than a height of each of the two edgefolds, the two edgefolds being respectively at a first end and a second end of the front edge of the subbase, the first end and the second end of the front edge being opposite with each other along a length direction of the front edge, and a climbing plate being arranged above the avoidance section; and a structural support assembly arranged above the bottom plate and forming an accommodation space above the subbase, an access opening being provided on a front side of the accommodation space;

wherein:

the two edgefolds are configured to be connected to the structural support assembly;

the avoidance section has a third end and a fourth end opposite with each other along the length direction of the front edge;

the heightened section has a fifth end and a sixth end opposite with each other along the length direction of the front edge; and one of the two edgefolds that is at the first end of the front edge is connected to the third end of the avoidance section, the fourth end of the avoidance section is connected to the fifth end of the heightened section, and the sixth end of the heightened section is connected to another one of the two edgefolds that is at the second end of the front edge.

20. A base comprising:

a bottom plate assembly including a subbase, a front edge of the subbase including a flanging folded upward and including an avoidance section, and a climbing plate being arranged above the avoidance section; and a structural support assembly arranged above the bottom plate and forming an accommodation space above the subbase, an access opening being provided on a front side of the accommodation space;

wherein the bottom plate assembly further includes:

four edgefold sets connecting the front edge and a first side edge of the subbase, connecting the front edge and a second side edge of the subbase, connecting the first side edge and a rear edge of the subbase opposite to the front edge, and connecting the second side edge and the rear edge, respectively; and three connection edgefolds respectively between two of the four edgefold sets, a height of each of the three connection edgefolds is lower than a height of each of the four edgefold sets, and higher than a height of the avoidance section.

* * * * *